United States Patent [19]

Luong et al.

[11] Patent Number: 4,688,360

[45] Date of Patent: Aug. 25, 1987

[54] ARTICULATED ELEMENT ANCHORAGE DEVICE HAVING A CRANKED SHAPE

[75] Inventors: Minh P. Luong, Montgeron; Pierre Habib, Paris, both of France

[73] Assignee: Institut Francais du Petrole, Rueil-Malmaison, France

[21] Appl. No.: 731,405

[22] Filed: May 7, 1985

[30] Foreign Application Priority Data

May 11, 1984 [FR] France ..... 84 07281

[51] Int. Cl.[4] ..... E02D 5/74

[52] U.S. Cl. ..... 52/166; 52/163; 114/294

[58] Field of Search ..... 52/163, 166; 114/294, 114/310, 304

[56] References Cited

U.S. PATENT DOCUMENTS 102,583 5/1870 Pattison ..... 114/310
1,002,350 9/1911 Wilcox ..... 52/163
1,566,846 12/1925 Fielding ..... 52/163
3,888,057 6/1975 Zubke ..... 52/166

*Primary Examiner*—Henry E. Raduazo
*Attorney, Agent, or Firm*—Antonelli, Terry & Wands

[57] ABSTRACT

The invention provides a high performance anchorage device for any type of ground, which is easy to use with known driving-in or propulsion processes. It comprises a main rigid body having at least one leading end for driving into the ground, at least one articulated element pivotably connected to said main body, and at least one anchorage line connected to said main body by a flexible connection. It further comprises the following combination:

(a) a cranked shape of said articulated element and (b) location of the center of gravity between the fastening point of said anchorage line and the articulation of said articulated element, said articulation and said fastening point being situated on each side of the driving in plane (Δ).

8 Claims, 11 Drawing Figures

Fα
3
10
11
2
9

Fα
3
Mc
10
11
2
9
Mo

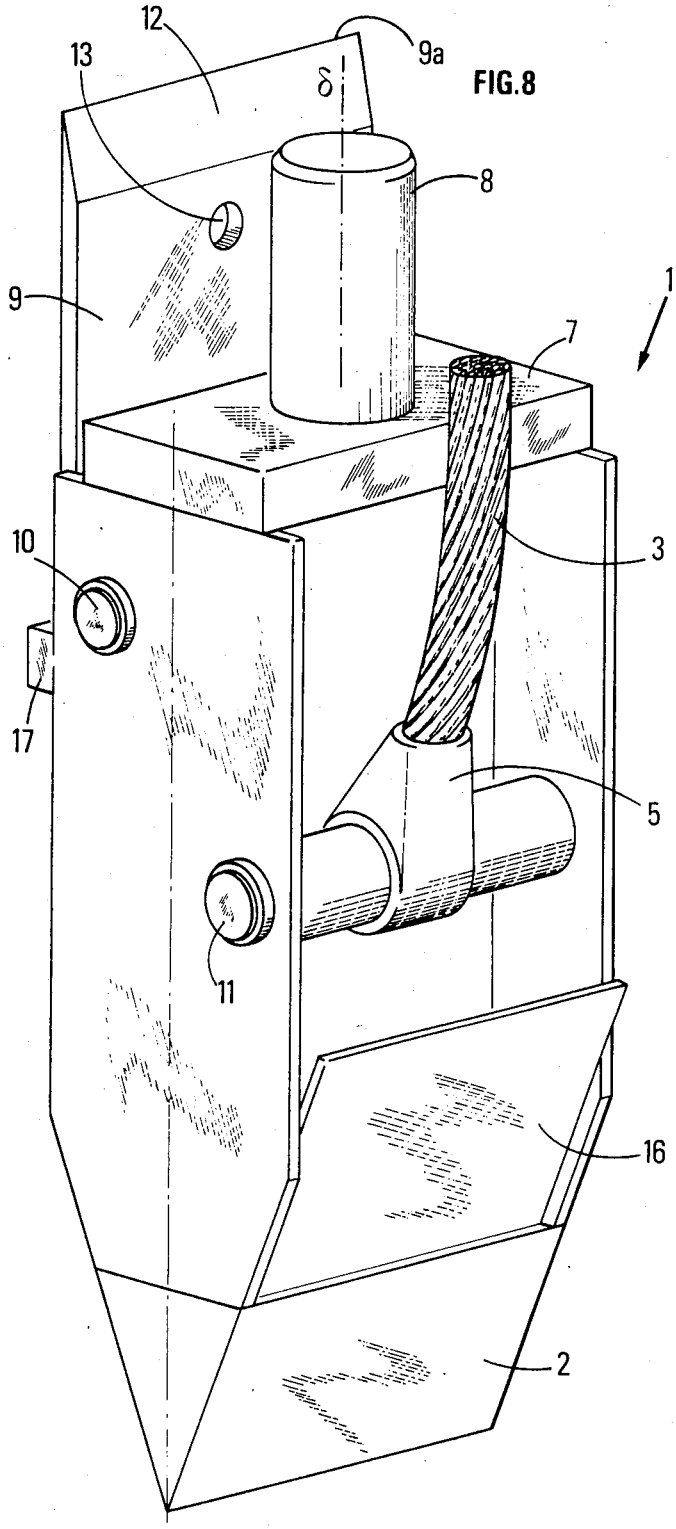
FIG.8
FIG.9
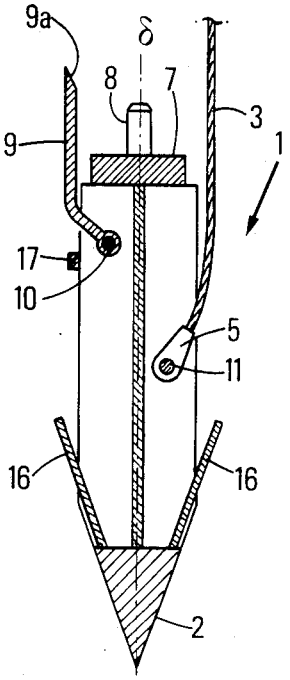

ARTICULATED ELEMENT ANCHORAGE DEVICE HAVING A CRANKED SHAPE

BACKGROUND OF THE INVENTION

1. Field of the Invention

The present invention relates to a novel articulated element anchorage device or system having a cranked shape for use in any soil by way of known positioning processes such as, for example, pile driving, vibrodriving, propulsion, and driving with a monitor and suction as is the case with loose soils, as well as for providing fixed anchorage points in water and, in particular, at port installations such as, for example, marinas, mooring pontoons, etc.

2. Description of the Prior Art

In, for example, French Pat. No. 79/00.038 an anchorage system is proposed with a free rotation of the fastening point situated forwardly of the center of gravity with respect to the end driven into the ground, but the positioning of the system is effected by pulling on the cable.

U.S. Pat. No. 3,282,002 proposes an anchorage device with free rotation of the fastening point provided with a flat plate adapted for rocking, with the angular movement of this plate being limited by a stop. However, the flat plate does not pivot by itself, but requires the assistance of a spring, even an explosive, so that it locks the anchorage device.

U.S. Pat. No. 3,888,057 proposes a device in which a tractive force must be exerted on an eye of a free mobile piece disposed centrally the anchorage plate so that a pin, perpendicular to the anchorage plate, and disposed in a front part close to the end driven into the ground may rise up and then cause the anchorage plate to rock. Thus, particularly in hard soils, the torque on the mobile part may be too small for the device to open and the plate will skid rearwardly without rocking.

Additional anchorage devices or systems are proposed in, for example, British Application No. 2,089,862, and French Applications Nos. 2,470,823 and 1,453,190, as well as U.S. Pat. No. 1,982,963.

To solve the problems encountered in the prior art, the question to be resolved, is how to provide high resistance anchorage points system on land and at sea which may reliably withstand a horizontal tractive force sloped upwardly and even vertically, between a ton and a hundred tons or so while being able to be positioned accurately and being adapted to accommodate all types of soils such as, for example, clay, sand, rocky soils, etc.

Anchorage piles or more generally groups of anchorage piles generally solve such a problem, but they have the disadvantage of being torn out when the vertical force applied is too great.

Some special anchors based on the principle of pivoting due to the off centering of the pull of the cable on the plate offers very poor reliability for the probability of correct operation is too low.

The aim underlying the present invention essentially resides in providing a new anchorage device or system which resolves the problems encountered in the prior art.

The invention provides an anchorage device comprising an anchorage element adapted for penetrating into the ground under the action of driving, more especially percussion, forces, with the anchorage element comprising at least one main rigid body having at least one end for driving into the ground, and with the driving forces being exerted substantially in a driving plane passing through end for driving into the ground and a driving or propulsion axis related to the main body. At least one articulated element is pivotably connected to the main body and has a limited angular movement, with at least one anchorage line being connected to the main body by a flexible connection at at least one fastening point disposed between the driving end and the center of gravity of the bearing surface of the main body. The fastening point is disposed forwardly of a center of gravity, and the driving plane passes through the center of gravity.

According to the present invention, the at least one articulated element has a crank shape, and a center of gravity between the fastening point for the anchorage line and the articulation of the articulated element is located at a predetermined point. Moreover, the present invention contemplates an off centering with respect to the driving plane, on the one hand, of the fixed fastening point and, on the other hand, of the articulation, with the latter being situated along an axis perpendicular to the driving or propulsion axis in a part disposed opposite to the end driven into the ground or surface so that the application of a pull on the anchorage line causes the articulated element to rock and the anchorage element to pivot.

The forces, more especially percussion forces, impart to the anchorage element a so called driving-in energy.

The cranked shape of the articulated element may advantageously have a concavity turned to the side opposite said driving in end.

The combination described is capable of providing, during the pull T exerted by the anchorage line, the best locking position for the anchorage device.

It is adapted for causing it to move in the ground when it is subjected to these forces and for orientating it so as to present an optimum main cross section for mobilizing the maximum thrust of the ground. By main cross section is meant the contour of the section transverse to the axis of movement of the anchorage element.

By flexible connection is meant here a connection introducing substantially no moment of rotation at the fastening point to the plate, such as a connection by wire, chain, ball joint or by an articulated threaded rod.

Burying in the ground is effected by driving forces brought into play by techniques such as, for example, driving, vibrodriving, propulsion, driving in with monitor, even suction in the case of loose soil, all known to a man skilled in the art and the choice will depend on the nature of the soil.

The angular movement of the cranked articulated element may be in a range of between 30° and 60° and, preferably, close to 45° with respect to the driving plane.

BRIEF DESCRIPTION OF THE DRAWINGS

Embodiments of the invention are illustrated by the accompanying drawings and diagrams wherein:

FIGS. 8 and 9 are, respectively, a perspective and cross-sectional view of another embodiment of the device or element of the invention and, FIG. 10 is a side view of another embodiment of an articulated element constructed in accordance with the present invention.

DESCRIPTION OF THE PREFERRED EMBODIMENTS

Figure 1:
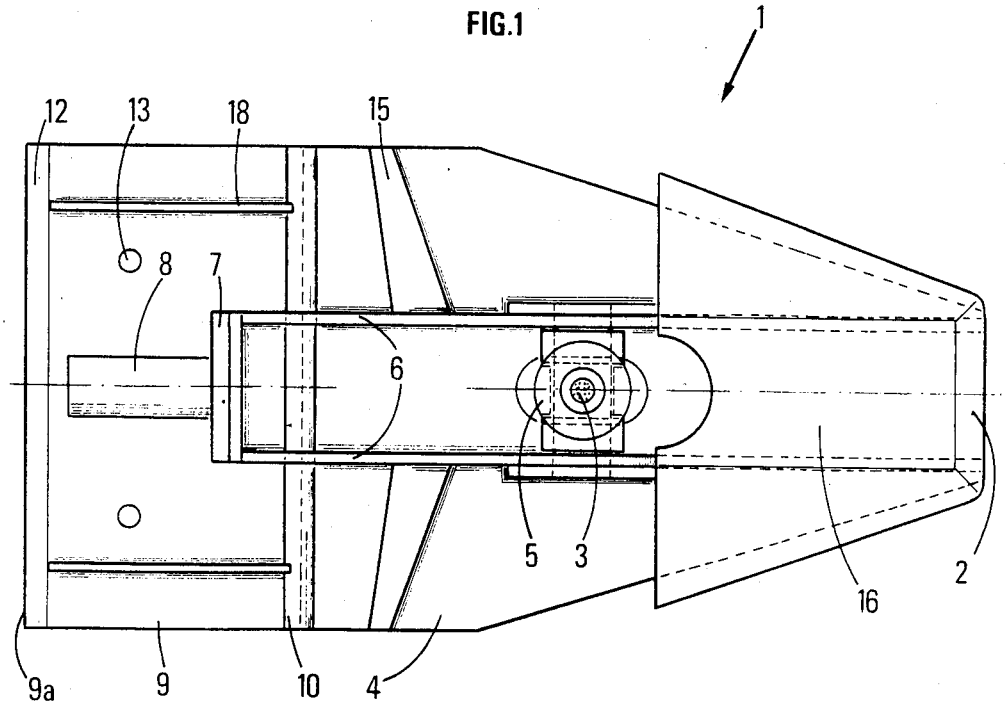
FIGS. 1 and 1A are schematic views of a first anchorage device or element constructed in accordance with the invention, seen from above and from the side respectively.

In FIG. 1 the anchorage device, for resisting a tractive force T at all angles of height (horizontal, upwardly sloping and vertical) comprises at least one anchorage element designated generally by the reference 1, which is generally vertically driven into the ground by one of its ends forming its driving end 2. An anchorage line 3 formed by, for example, a wire, a chain or an articulated threaded rod, for transmitting the tractive force T to be withstood, through a traction shaft 11, is fastened to the anchorage element 1 at at least one point by a flexible connection 5 such as, for example, a ball joint introducing substantially no twisting or bending moment, at the fastening point to the traction shaft 11. The position of this latter on the anchorage element 1 is chosen so that the point of application of the tractive force The to the anchorage element 1 is situated forwardly of the barycenter, or a center of gravity G, of the bearing surface buried in the ground, or main cross section of said anchorage element, towards the driving end 2. The anchorage element 1 includes at least one main body comprising a rigid dorsal part 6, on which bears a sole piece 4 having deflectors 15 on its internal face, with the rigid dorsal part 6 withstanding and transmitting the driving energy to the driving end 2.

It is transmitted first of all to an anvil 7 which rests on the rigid part 6 and which has mounted thereon a guide pin 8 for receiving the driving element, with the guide pin 8 having a length H of two to six times its cross dimension d. Preferably, a male pin is provided so as to avoid any risk of jamming of the driving element resulting from a bruising phenomenon during the impact on the anvil 7. This pin may have any shape such as, for example, a square, rectangular, round, oval or diamond.

Figure 10:
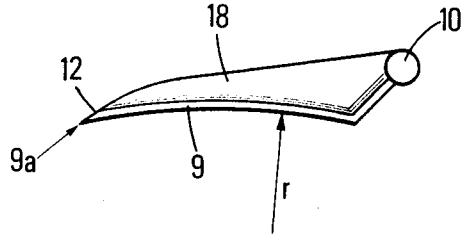

In its part opposite the end 2 is driven into the driving ground, the anchorage element 1 is equipped with a cranked articulated element 9 having stiffness or reinforcement 18 in its internal part opposite pin 8, which pivots on an articulation shaft 10 perpendicular to the shaft of the anchorage element 1 in the driving plane Δ as far as a maximum position fixed by a stop 17 defining an angular movement of $\alpha$ in a range of between 30° to 60° with respect to the axis of the anchorage element which is in the driving plane Δ and which passes the guide pin 8. The articulated element 9 has a flat part on the part of the crank the furthest from the articulation shaft 10. In another embodiment illustrated in FIG. 10, the part of the articulated element 9 the furthest away from the articulation shaft 10 has a curved shape whose radius of curvature r is at least equal to the distance separating said articulation shaft 10 from the end 2 driven into the ground.

The length of the articulated element 9 which separates articulation shaft 10 from a free end 9*a* of the articulated element 9 is between a one-half and a one-tenth of the total length of the anchorage element and particularly interesting results have been obtained with a value substantially equal to a one-third of the total length of the anchorage element 1.

The articulated element 1 is such that the crank in the vertical position at the moment of driving, i.e. aligned with the sole-piece 4, is in a shadow of the main cross section of the anchorage device, that is, the contour of the section transverse to the axis of movement of said anchorage element 1.

The driving distance from the end 2 driven into the ground to the traction shaft 11 forming the fastening point for the anchorage line 3 is between a one-quarter and one-half of the total length of the anchorage element 1. Good performances have been obtained when the distance was preferably equal to a one-third.

The ratio of the length of the anchorage element defined through the driving plane Δ to the width of the anchorage element 1 is between one third and ten and, preferably, between one and five.

It has been mentioned that the distance from the driving end 2 driven into the ground to the traction shaft 11 or fastening point 11 is between a one-quarter and one-half of the total length of the anchorage element 1 and, preferably, equal to a one-third of the length.

Good results were obtained when the length of the articulated element 9 between articulation shaft 10 and its free end 9*a*, the distance separating articulation shaft 10 of the anchorage element 1 from the fastening point 11 of the anchorage line 3 and the distance separating said fastening point 11 from the driving end 2 of the anchorage element 1 are each substantially equal to one third of the total length of the anchorage element 1.

Figure 1A:
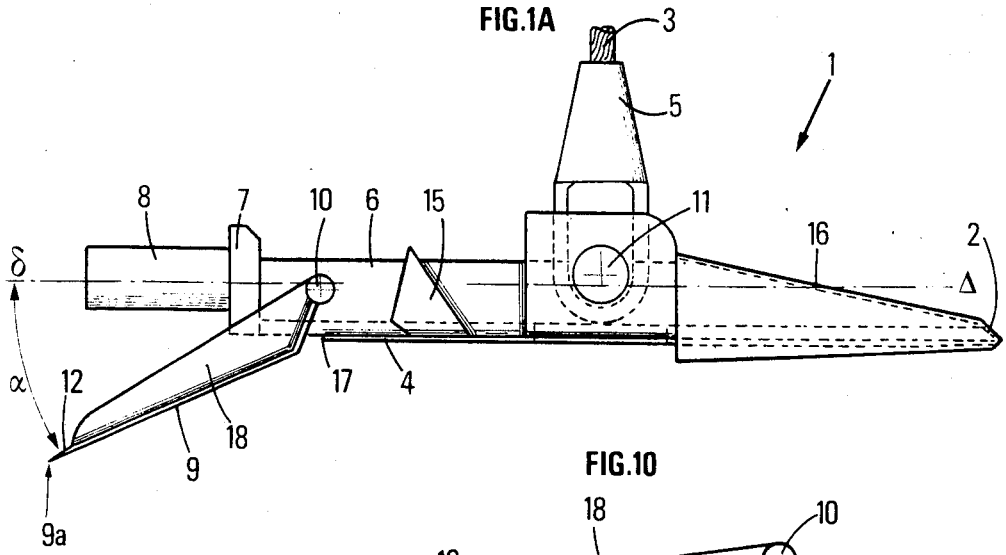

The driving end 2 driven into the ground may have an asymmetric shape with respect to the driving plane Δ (FIG. 1A). It may also have a symmetrical shape with respect to the same driving plane Δ (FIG. 9).

It must moreover be symmetrical with respect to a plane perpendicular to the driving plane passing through the driving axis: its shape may then be for example pointed, straight (FIG. 8), even trapezoidal such as the one shown in FIG. 1.

The driving end 2 driven into the ground is extended by a wing 16 which may, for example be made from steel or a plastic material, which puts the sensitive elements of the anchorage device "in the shade" and, more particularly the cranked articulated element 9, the anchorage line 3 and the flexible connection. The wing 16 extends from the sole piece 4 so as to correctly guide the movement of the anchorage element 1.

The anchorage device of the invention may be used the following manner prior to driving the anchorage element 1 the anchorage line 3 is fastened thereto, with a diameter thereof being selected so as to be less than the dimension of the anchorage element 1 in section through a plane perpendicular to the direction of application of the driving force and along the anchorage element 1.

The anchorage line 3 is fastened to a side opposite a leading end of the anchorage element 1. The anchorage element 1 is applied to the portion of the anchorage line 3 adjacent fastening point 11, so as to cause the anchorage line 3 to penetrate into the ground at the same time as the anchorage element 1.

The anchorage element 1 is designed so that the main cross section is the smallest possible so as to benefit as much as possible from the driving energy. Preferably, the anchorage element 1 is positioned in front of all the pivotable members, that is, anchorage line or cable 3 and articulated element 9, so that they are protected during driving in since they are in the "shade" of the main cross section.

After the anchorage element 1 is driven to the desired depth, a pull exerted on the anchorage line 3 at the surface, at any height upwardly, induces a vertical upward component which immediately and spontaneously causes the articulated element 9 to rock and the anchorage element 1 to pivot.

Three inherent characteristics of the anchorage device of the invention allow this rocking mechanism to be tripped when these characteristics are used in combination.

Figure 2:
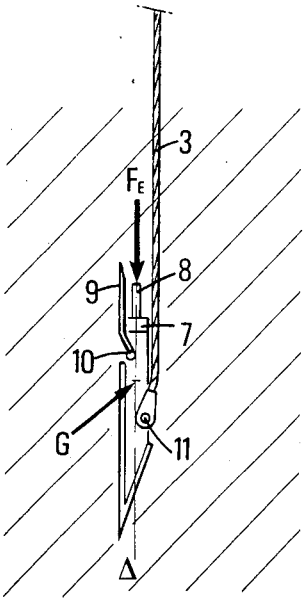
FIGS. 2, 3, 4, 5, 6, and 7 illustrate the sequence of positioning and locking the device of the invention in different soils.
Figure 3:
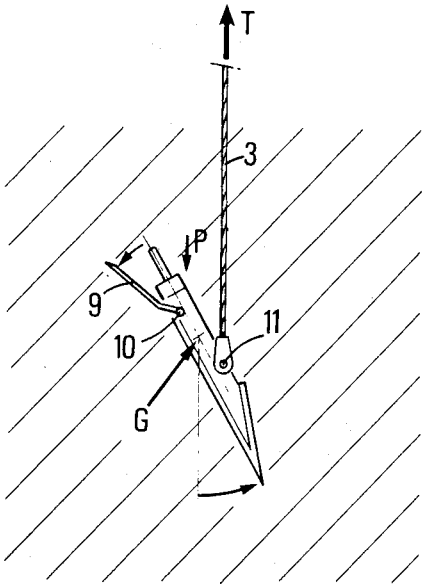

More particularly, the articulated element 9 has a cranked shape, with the concavity of the crank shaped element 9 being turned to the side opposite driving or leading end 2. The end 12 of the articulated element 9 has at its free end 9*a* a chamfer whose edge is turned outwardly. additionally, the traction shaft 11 and articulation shaft 10 of the articulated element 9 are off centered (FIG. 2) with respect to the driving plane Δ passing through the center of gravity G of the anchorage element 1. This off centering promotes the beginning of rocking of the anchorage element with respect to a horizontal axis, furthermore, the position of the center of gravity between the fastening point to the traction shaft 11 and the articulation or pivoting shaft 10 promotes the driving torque due to the pull P exerted on the anchorage line 3 and to the pressure of the ground on the articulated element 9. FIG. 3 shows schematically the beginning of pivoting of the rocking part.

Figure 4:
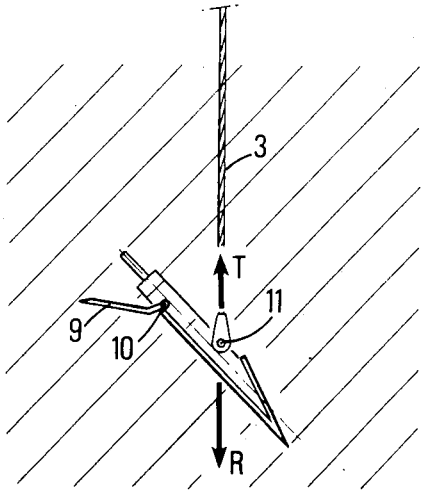

The rocking stops (FIG. 4) when the barycentric resultant r of the pressure of the earth or ground abutting against the main cross section of the anchorage element 1 is aligned with the pull T on the cable. In this case, T is less than R.

Figures 5, 7:
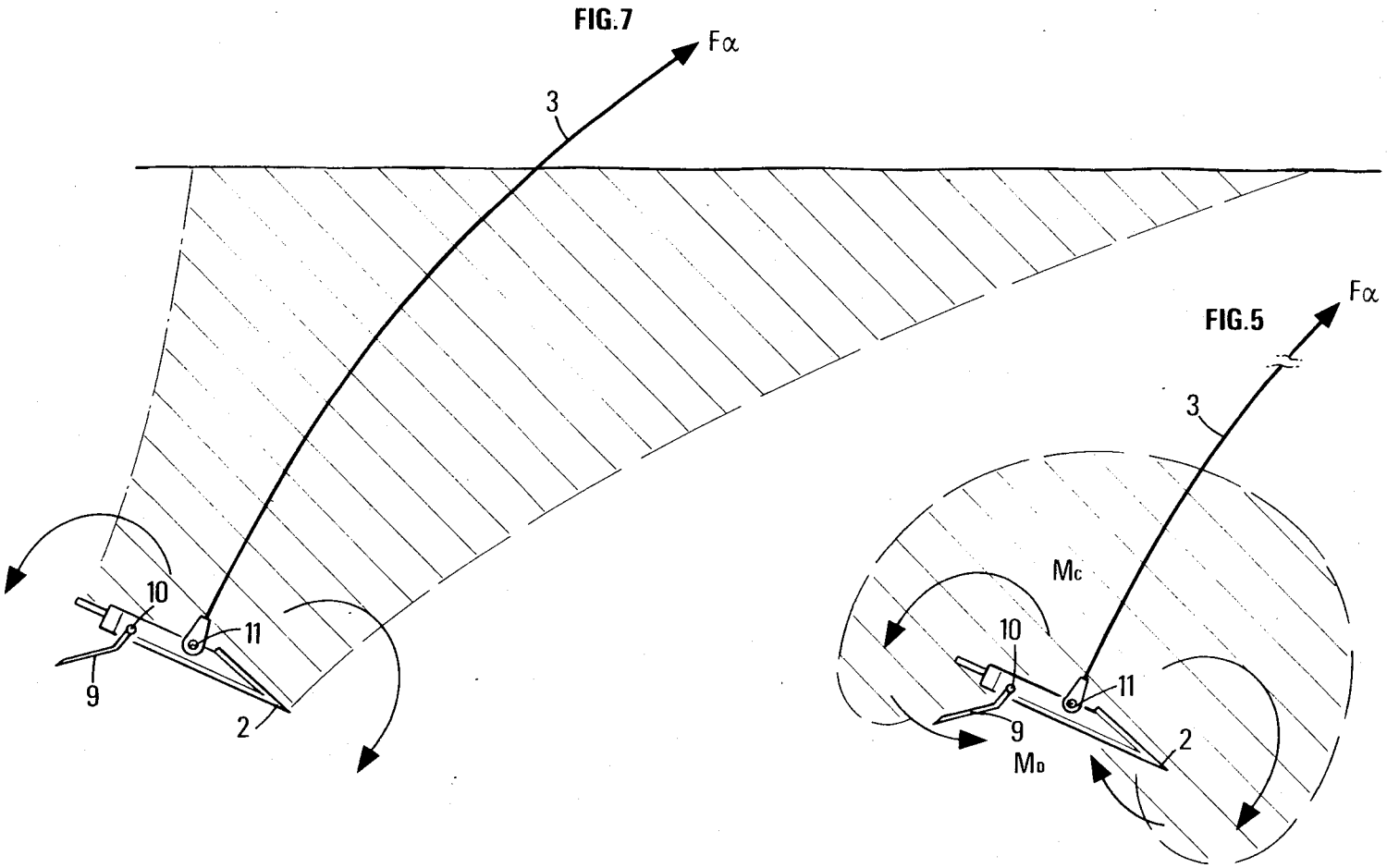

If the anchorage element 1 has been positioned at a depth greater than the critical depth, i.e., two-five times times the largest dimension of the anchorage element 1, the underground earth abutment mechanism is perfectly stable in that there is a flow of soil material from the compressed side $M_C$ to the decompressed side $M_D$. In such a situation the static anchorage resistance or permanent anchorage resistance $F_\alpha$ is perfectly stable (FIG. 5).

Figure 6:
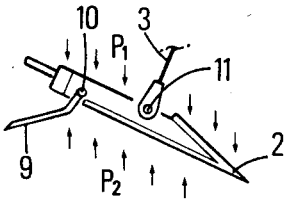

In the case of a saturated soil (at the bottom of the sea) (FIG. 6), a rapid pull with respect to the flow of the interstitial water in the pores caused a suction effect $F_D$ which is added to the previously mentioned static resistance $F_\alpha$ for resisting the dynamic forces on the anchorage line.

The force $F_D$ is expressed in accordance with the following relationship:

$$F_D=(P_1-P_2)S,$$

wherein:

S=an area of the anchorage element 1, and $P_1$ and $P_2$=pressures of the interstitial water at the front and rear of the anchorage element 1.

At a small buried depth (FIG. 7), the anchorage resistance is limited by the driving force F of a volume of soil having the approximate shape of an inclined inverted cone situated above the anchorage system (hatched zone).

The device may be possibly withdrawn from the ground. For this, it will, for example, be provided with at least one extraction cable or any other known extraction means, fixed to at least one point 13 on the articulated element 9 and which possibly allows the anchorage element 1 to be extracted from the soil by a vertical or rearward pull exerted from the surface.

A particularly advantageous embodiment of the anchorage device of the invention is illustrated in FIGS. 8 and 9. Its more compact shape, its leading end 2 symmetrical with respect to the driving plane Δ and its main body 6 shaped in a IPN or HPN section on which rests a larger anvil 7 provide, because of smaller main cross section, good burying of the anchorage device in hard soils as well as in soft rocks and a good locking position.

The types of anchors of the invention may be disposed in series or in parallel while being connected together by anchorage lines 3. This anchorage device then increases the anchorage force.

Laboratory tests have been carried out with an anchorage device weighing 2.8 kilograms. The anchorage device was buried by driving into sand saturated with water at a depth of 1.35 meter. The characteristics or conditions of the anchorage device were as follows:

total length of the anchor: 330 mm
total width of the anchor: 160 mm
length of the articulated element L: 100 mm
width of the articulated element 1: 160 mm
angle of the crank of the articulated element: 125°
angular movement: 55°
cross dimension of the pin d: 20 mm
length of the pin h: 50 mm
distance between the traction shaft and the pivoting shaft: 95 mm
distance between the traction shaft and the leading end: 135 mm Under the above conditions, a horizontal tractive force T of 3 tons and a vertical tractive force of 1.5 tons were exerted without the anchorage device leaving the ground.

The anchorage device of the invention is suitable for work at sea and provides a very high anchorage resistance for floating or semi floating supports whatever the ground conditions encountered. It may maintain the floating or semifloating supports strictly in position and also ensure a long service life of the anchorage device.

What is claimed is:

1. In an anchorage device comprising an anchorage element adapted for penetrating into a ground under an action of driving forces, more especially percussion forces, said anchorage element comprising at least one main rigid body having at least one leading end to be driven into the ground, said at least one main rigid body including a bearing surface having a center of gravity, said driving forces being exerted substantially through a driving plane passing through said leading end and said center of gravity, and a driving or propulsion axis related to the at least one main rigid body, at least one articulated element having an articulation, said at least one articulated element being pivotally connected to said at least one main rigid body and having a limited angular movement, at least one anchorage line connected to said at least one main rigid body by a flexible connection to at least one fastening point situated between said leading end and the center of gravity of the bearing surface of the at least one main rigid body, said fastening point being disposed forwardly of the center of gravity, the improvement comprising:

(a) a crank shape of said at least one articulated element, (b) location of said center of gravity between said fastening point of the at least one anchorage line and the articulation of said at least one articulated element, and (c) each of said fastening point and said articulation being off center in opposite directions with respect to the driving plane, said fastening point being fixed and said articulation being situated along an articulation axis perpendicular to said driving or propulsion axis in a part of the main rigid body opposite to the leading end to be driven into the ground, so that the application of a pull on said anchorage line causes the at least on articulated element to begin rocking and the anchorage element to pivot.

2. The anchorage device as claimed in claim 1, wherein the cranked shape of said at least one articulated element has a concavity turned to the side opposite said leading end.

3. The anchorage device as claimed in claim 1, wherein said at least one articulated element includes a first flat part on a portion of the crank the furthest away from said articulation.

4. The anchorage device as claimed in claim 1, wherein the portion of said at least one articulated element the furthest away from said articulation has a curved shape with a radius of curvature at least equal to a distance separating said articulation from aid leading end driven in to the ground.

5. The anchorage device as claimed in any one of claims 1 to 4, wherein said at least one articulated element has a free end, and wherein the free end includes a chamfer whose edge is directed outwardly.

6. The anchorage device as claimed in any one of claims 1 to 4, wherein an angular movement of said at least one articulated element with respect to said driving-in plane is between 30° and 60° and is preferably close to 45°.

7. The anchorage device as claimed in any one of claims 1 to 4, wherein a length of the at least one articulated element separating the articulation from a free end of said at least one articulated element is between one-half and one-tenth of a total length of the anchorage element.

8. The anchorage element as claimed in any one of claims 1 to 4, comprising a member for guiding the driving-in forces, said member having a length between 2 and 6 times its cross dimension.

* * * * *